US011187193B1

(12) United States Patent
Oh et al.

(10) Patent No.: US 11,187,193 B1
(45) Date of Patent: Nov. 30, 2021

(54) ACTIVE DUAL PURGE SYSTEM AND METHOD OF DIAGNOSING ACTIVE DUAL PURGE SYSTEM USING ONBOARD DIAGNOSIS

(71) Applicants: HYUNDAI MOTOR COMPANY, Seoul (KR); KIA MOTORS CORPORATION, Seoul (KR)

(72) Inventors: Young-Kyu Oh, Gwacheon-si (KR); Keum-Jin Park, Anyang-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 17/114,860

(22) Filed: Dec. 8, 2020

(30) Foreign Application Priority Data

May 19, 2020 (KR) ..... 10-2020-0059676

(51) Int. Cl.
*F02M 25/08* (2006.01)
*F02M 35/10* (2006.01)
*G07C 5/08* (2006.01)

(52) U.S. Cl.
CPC .... *F02M 25/0818* (2013.01); *F02M 25/0827* (2013.01); *F02M 25/0836* (2013.01); *F02M 25/0872* (2013.01); *F02M 35/10157* (2013.01); *F02M 35/10222* (2013.01); *G07C 5/0808* (2013.01)

(58) Field of Classification Search
CPC ..... F02M 25/0818; F02M 25/0872; F02M 25/0836; F02M 25/0827; F02M 35/10222; F02M 35/10157; G07C 5/0808
See application file for complete search history.

(56) References Cited

U.S. PATENT DOCUMENTS 10,480,431 B1 * 11/2019 Dudar ..... F02M 25/0854
2014/0060160 A1 * 3/2014 Pursifull ..... G01M 3/28 73/40
2014/0345573 A1 * 11/2014 Jefford ..... F02M 25/0818 123/519
2015/0275826 A1 * 10/2015 Balsdon ..... F02M 25/0872 123/518
2016/0123280 A1 * 5/2016 Makino ..... F02M 25/089 123/519

(Continued)

FOREIGN PATENT DOCUMENTS

KR 2018/0135565 A1 5/2018

*Primary Examiner* — Xiao En Mo

(74) *Attorney, Agent, or Firm* — Lempia Summerfield Katz LLC

(57) ABSTRACT

An active dual purge system includes: an intake pipe, a compressor to compress air, a canister to collect an evaporation gas, a purge line extending from the canister to a front end of the compressor, a branch line branching off from the purge line and extending to a rear end of a throttle valve body, a purge pump installed in the purge line, a purge valve installed in the purge line, a vent valve installed in a vent line extending from the canister toward the atmosphere, a first sensor installed in the purge line, and a second sensor installed in the purge line, and a controller to perform different tests on the purge pump, the purge valve and the vent valve in different operating states, and diagnose whether at least one of the purge line, the branch line, or the vent line are abnormal using on-board diagnosis (OBD).

21 Claims, 6 Drawing Sheets

(56) References Cited

U.S. PATENT DOCUMENTS

| | | | | |
|---|---|---|---|---|
| 2016/0290285 | A1* | 10/2016 | Dudar | F01N 5/04 |
| 2018/0135565 | A1 | 5/2018 | Choi et al. | |
| 2018/0187614 | A1* | 7/2018 | Dudar | F02M 25/0827 |
| 2019/0078976 | A1* | 3/2019 | Nelson | G01M 3/26 |
| 2019/0368431 | A1* | 12/2019 | Dudar | F02M 25/0818 |
| 2020/0256286 | A1* | 8/2020 | Asanuma | F02M 25/0836 |

* cited by examiner

| POSITION | TYPE OF TEST | |
|---|---|---|
| | PULLING OUT OF HOSE (LEAK) | CLOGGING OF HOSE |
| ① | A,E | A,B,E |
| ② | A,B,C,D,E,F | A,B,E |
| ③ | A,B,C,D,E,F | A,B,E,F |
| ④ | A,B,C,D,E | A,B,D,E |
| ⑤ | C,D | D |
| ⑥ | C,B,D,E | D,E |
| ⑦ | - | D |
| ⑧ | A,B,C,D,E,F | A,B,E,F |
| ⑨ | A,B,C,D,E,F | A,B,E |

FIG.6 "PRIOR ART"
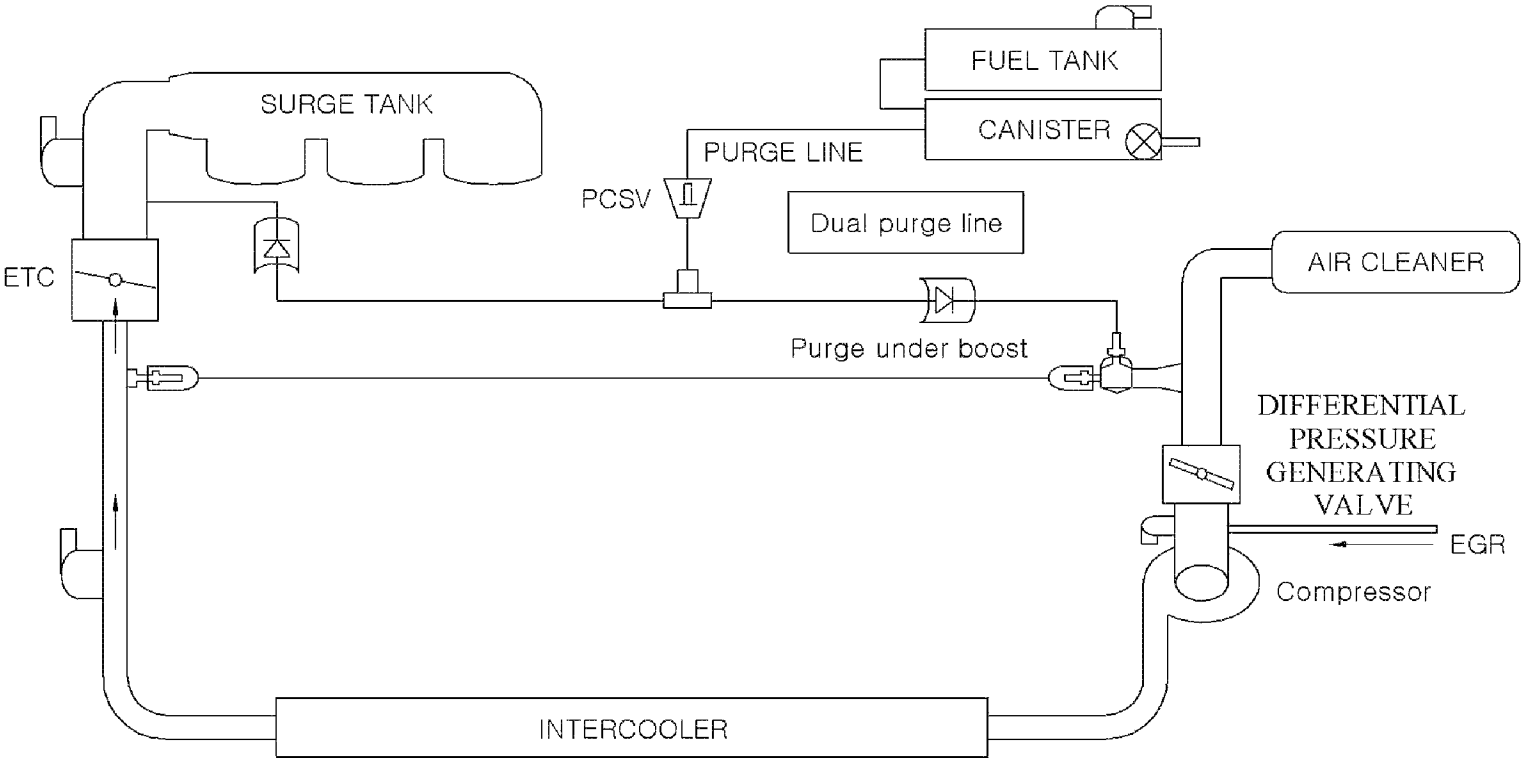

ACTIVE DUAL PURGE SYSTEM AND METHOD OF DIAGNOSING ACTIVE DUAL PURGE SYSTEM USING ONBOARD DIAGNOSIS

CROSS-REFERENCE TO RELATED APPLICATIONS

This application claims priority to and the benefit of Korean Patent Application No. 10-2020-0059676, filed on May 19, 2020, the entire contents of which are incorporated herein by reference.

FIELD

The present disclosure relates to an active dual purge system and a method of diagnosing an active dual purge system using an on-board diagnosis (OBD).

BACKGROUND

The statements in this section merely provide background information related to the present disclosure and may not constitute prior art.

A turbocharger is installed as a supercharger in a vehicle. The turbocharger is a device which compresses intake air while a compressor installed in an intake pipe is dependently rotated when a charger installed in an exhaust pipe is rotated due to an exhaust gas. Since the intake air is compressed through the turbocharger, a larger amount of air can be supercharged to a combustion chamber so that more fuel can be combusted.

Meanwhile, an evaporation gas evaporated from a fuel tank is collected in a canister. The canister and the intake pipe are connected through a purge line, and the evaporation gas collected in the canister is transferred to the intake pipe through the purge line due to an intake pressure generated in the intake pipe. However, when the turbocharger is operated, since a pressure equal to or higher than an atmospheric pressure is generated in the intake pipe, the intake pressure is difficult to be generated in the intake pipe, and, on the contrary, there is a probability in that the intake air is moved from the intake pipe to the purge line.

As shown in FIG. 6, in the dual purge system, a branch line is formed from a purge line to a rear end of a throttle valve body. When a corrected mass flow rate is not present or is small due to revolutions per minute (RPM) of an engine or deformation in blade of the turbocharger, and thus intake air is introduced into a surge tank due to a pumping pressure of the engine, a negative pressure is generated at the rear end of the throttle valve body so that the evaporation gas is introduced into the surge tank through the branch line.

In addition, when the RPM of the engine is increased and thus a corrected mass flow rate of the turbocharger becomes larger, a differential pressure generating valve is operated to reduce a volume of the intake air through an air cleaner and increase an inflow amount of external air through a canister and, simultaneously, increase an amount of a purge gas which means an inflow of the evaporation gas into a front end of the compressor.

However, when the corrected mass flow rate of the turbocharger is large, a phenomenon in which the intake air flows back along a wall surface of the intake pipe may occur. In addition, as a flow rate of the evaporation gas introduced into the front end of the compressor is increased, a probability in that the evaporation gas is mixed with the intake air flowing back in the intake pipe is increased. The evaporation gas included in the intake air flowing back cannot be combusted in the combustion chamber, can contaminate the air cleaner, and can be discharged into the atmosphere.

Meanwhile, on-board diagnosis (OBD)-I system is a system for detecting malfunctions of exhaust gas-related parts of a vehicle and an increase in harmful exhaust gas due to a failure, lighting a maintenance indicator lamp provided in an instrument panel of an interior of the vehicle, and notifying a driver of the malfunctions and failure.

In addition, OBD-II is one of regulations related to exhaust gases of vehicles in the United States. OBD-II is a regulation for regulating, when a computer embedded in the vehicle diagnoses an exhaust gas control part or system during driving and then determines the exhaust gas control part or system as being failing, the computer to store a diagnostic trouble code (DTC) and turn a malfunction indicator light (MIL) on. Since conventional OBD-I systems applied for the first time inspect only disconnection of wiring with electronic components and the like, the conventional OBD-I systems cannot check degradation in catalyst or oxygen sensor and an increase of an exhaust gas due to an abnormal behavior of the oxygen sensor or an actuator, and lots of confusion and discomfort are caused in which connectors for connecting to diagnostic equipment, DTCs, lighting standards for MILs, and types of stored information are not standardized so that different connectors are required for vehicles or manufacturers, and various pieces of different data should be provided so as to interpret the DTCs.

In order to solve the above problems, the OBD-II is amended such that standardized connectors for connecting to general purpose diagnostic equipment, standardized terms for electronic control parts according to a communication specification, and standardized DTCs should be used, and a failure determination criteria and diagnostic requirements are added for each item in which an exhaust gas will be increased when a failure occurs.

However, we have found that in a dual purge system, upon performing a purge using a negative pressure generated at a front end of the compressor, when a check valve installed in a branch line branching to an intake pipe and a hose on the intake pipe are pulled out or clogging occurs in the check valve, it is difficult to diagnose a corresponding failure using the OBD due to a lack of discrimination through fuel tank pressure diagnosis.

SUMMARY

The present disclosure provides an active dual purge system and a method of diagnosing a failure of an active dual purge system, which are capable of preventing an evaporation gas introduced into a front end of a compressor from flowing back and contaminating an air cleaner due to a backflow of intake air which may occur according to an operation of the compressor, diagnosing the active dual purge system and a failure which will occur in the active dual purge system, and classifying a type of the failure to warn a driver of the failure.

Other objects and advantages of the present disclosure can be understood by the following description and become apparent with reference to the forms of the present disclosure. Also, it is obvious to those skilled in the art to which the present disclosure pertains that the objects and advantages of the present disclosure can be realized by the means as claimed and combinations thereof.

In one form of the present disclosure, an active dual purge system includes: an intake pipe, a compressor installed in the intake pipe and configured to compress air, a canister configured to collect an evaporation gas evaporated in a fuel tank, a purge line extending from the canister to a front end of the compressor in the intake pipe, a branch line branching off from the purge line and extending to a rear end of a throttle valve body provided in the intake pipe, a purge pump installed in the purge line to be located between the canister and a branch position of the branch line, a purge valve installed in the purge line to be located between the branch position of the branch line and the intake pipe, a vent valve installed in a vent line extending from the canister toward the atmosphere, a first sensor installed in the purge line to be located between the purge pump and the purge valve, a second sensor installed in the purge line to be located between the canister and the purge pump, and a control unit configured to perform different tests on the purge pump, the purge valve and the vent valve, which are in different operating states, and diagnose whether at least one of the purge line, the branch line, or the vent line is abnormal using on-board diagnosis (OBD).

In one form, the active dual purge system may further include a first valve installed in the purge line to be located between the branch position of the branch line and the purge valve, and a second valve installed in the branch line to be located between the branch position of the branch line and the throttle valve body, wherein the first sensor may be located between the first valve and the purge valve, and the active dual purge system may further include a third sensor installed in the branch line to be located between the second valve and the throttle valve body.

In some forms of the present disclosure, the active dual purge system may further include a differential pressure generating valve provided in the intake pipe to be located between a connection point of the purge line and the intake pipe and an air cleaner provided in the intake pipe, and the control unit may control the differential pressure generating valve, the purge valve, the first valve, the second valve, and the purge pump.

In some forms of the present disclosure, the active dual purge system may further include a first check valve installed in the purge line to be located between the purge valve and the intake pipe, a second check valve installed in the purge line to be located between the first valve and the purge valve, and a third check valve installed in the branch line to be located between the second valve and the throttle valve body.

In some forms of the present disclosure, the first check valve may be directly engaged with the compressor and is integrated therewith.

In some forms of the present disclosure, an outer circumference of an end portion of a discharge side of the first check valve may be screw-coupled to the compressor to be directly engaged with the compressor.

In some forms of the present disclosure, an outer circumference of an end portion of a discharge side of the first check valve is bonded to the compressor by an adhesive to be directly engaged with the compressor.

In another form of the present disclosure, a method of diagnosing an active dual purge system using an on-board diagnosis (OBD), wherein the active dual purge system includes an intake pipe, a compressor installed in the intake pipe and configured to compress air, a canister configured to collect an evaporation gas evaporated in a fuel tank, a purge line extending from the canister to a front end of the compressor in the intake pipe, a branch line branching off from the purge line and extending to a rear end of a throttle valve body provided in the intake pipe, a purge pump installed in the purge line to be located between the canister and a branch position of the branch line, a purge valve installed in the purge line to be located between the branch position of the branch line and the intake pipe, a vent valve installed in a vent line extending from the canister toward the atmosphere, a first sensor installed in the purge line to be located between the purge pump and the purge valve, and a second sensor installed in the purge line to be located between the canister and the purge pump, the method comprising: diagnosing a failure by performing one or more tests in which operating states of the purge pump, the purge valve, and the vent valve are different from each other; and diagnosing whether the purge line, the branch line, and the vent line are abnormal using OBD.

In some forms of the present disclosure, the one or more tests may include at least one among Test A for diagnosing a failure of the purge valve, Test B for diagnosing an internal pressure range of the purge line, Test C for diagnosing a leakage of the purge line, Test D for diagnosing whether the purge line is vacuumed, and Test E for diagnosing a load of the canister.

In some forms of the present disclosure, Test A may be performed in a state in which the purge pump is not operated, an amount of opening degree of the purge valve is 50%, and the vent valve is opened, Test B may be performed in a state in which the purge pump is operated, the amount of opening degree of the purge valve is 100%, and the vent valve is opened, Test C may be performed in a state in which the purge pump is not operated, the amount of opening degree of the purge valve is 0%, and the vent valve is closed, Test D may be performed in a state in which the purge pump is operated, the amount of opening degree of the purge valve is 100%, and the vent valve is closed, and Test E may be performed in a state in which the purge pump is not operated, the amount of opening degree of the purge valve is 100%, and the vent valve is opened.

In some forms of the present disclosure, the active dual purge system may further include a first check valve installed in the purge line to be located between the purge valve and the intake pipe, a second check valve installed in the purge line to be located between the first valve and the purge valve, and a third check valve installed in the branch line to be located between the second valve and the throttle valve body, wherein the one or more tests may further include Test F for diagnosing whether the first check valve, the second check valve, and the third check valve are abnormal, and Test F may be performed in a state in which the purge pump is not operated, the amount of opening degree of the purge valve is 50%, and the vent valve is opened.

In some forms of the present disclosure, during the performing of the one or more tests, when a magnitude of a signal generated by the first sensor provided between the purge pump and the purge valve, a magnitude of a signal generated by the second sensor provided between the canister and the purge pump, and revolutions per minute (RPM) of the purge pump fall within a predetermined appropriate range, the performed one or more tests may be determined to pass, when the magnitude of the signal generated by the first sensor, the magnitude of the signal generated by the second sensor, and the RPM of the purge pump do not fall within the predetermined appropriate range, the performed one or more tests may be determined to fail, and whether the purge line, the branch line, and the vent line are abnormal may be diagnosed using the OBD on the basis of the above test results.

In some forms of the present disclosure, in a first section between the purge valve and the intake pipe in the purge line, when either Test A or Test E fails, it may be estimated that a leak or a pulling out of a hose constituting the purge line occurs, and when any one among Test A, Test B, and Test E fails, it may be estimated that clogging of the hose constituting the purge line occurs.

In some forms of the present disclosure, in a fourth section between the purge pump and the branch position in the purge line, when any one among Test A, Test B, Test C, Test D, and Test E fails, it may be estimated that a leak or a pulling out of a hose constituting the purge line occurs, and when any one among Test A, Test B, Test D, and Test E fails, it may be estimated that clogging of the hose constituting the purge line occurs.

In some forms of the present disclosure, in a fifth section between the purge pump and the canister in the purge line, when either Test C or Test D fails, it may be estimated that a leak or a pulling out of a hose constituting the purge line occurs, and when Test D fails, it may be estimated that clogging of the hose constituting the purge line occurs.

In some forms of the present disclosure, in a sixth section between the canister and the fuel tank in the purge line, when any one among Test C, Test B, Test D, and Test E fails, it may be estimated that a leak or a pulling out of a hose constituting the purge line occurs, and when either Test D or Test E fails, it may be estimated that clogging of the hose constituting the purge line occurs.

In some forms of the present disclosure, in a seventh section which is the vent line, when Test D fails, it may be estimated that clogging of a hose constituting the vent line occurs.

In some forms of the present disclosure, in a second section between the purge valve and the first sensor in the purge line, when any one among Test A, Test B, Test C, Test D, Test E, and Test F fails, it may be estimated that a leak or a pulling out of a hose constituting the purge line occurs, and when any one among Test A, Test B, and Test E fails, it may be estimated that clogging of the hose constituting the purge line occurs.

In some forms of the present disclosure, in a third section between the first sensor and the first valve in the purge line, when any one among Test A, Test B, Test C, Test D, Test E, and Test F fails, it may be estimated that a leak or a pulling out of a hose constituting the purge line occurs, and when any one among Test A, Test B, Test E, and Test F fails, it may be estimated that clogging of the hose constituting the purge line occurs.

In some forms of the present disclosure, in an eighth section between the branch position and the second sensor in the branch line, when any one among Test A, Test B, Test C, Test D, Test E, and Test F fails, it may be estimated that a leak or a pulling out of a hose constituting the purge line occurs, and when any one among Test A, Test B, Test E, and Test F fails, it may be estimated that clogging of the hose constituting the purge line occurs.

In some forms of the present disclosure, in a ninth section between the second sensor and the intake pipe in the purge line, when any one among Test A, Test B, Test C, Test D, Test E, and Test F fails, it may be estimated that a leak or a pulling out of a hose constituting the purge line occurs, and when any one among Test A, Test B, and Test E fails, it may be estimated that clogging of the hose constituting the purge line occurs.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 6 is an exemplary diagram illustrating a conventional dual purge system.

Figure 1:
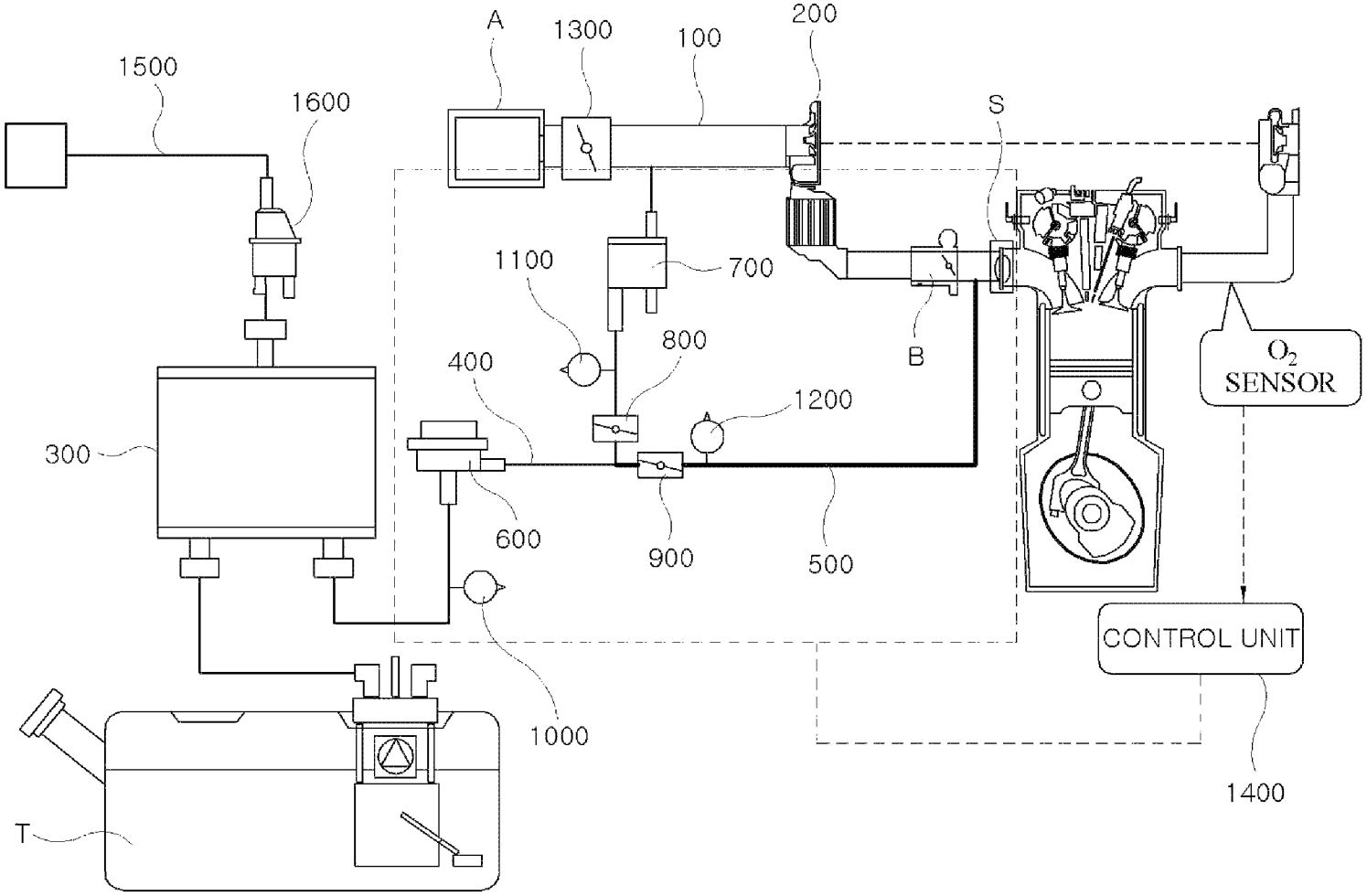
FIG. 1 is an exemplary diagram illustrating an active dual purge system in one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, an active dual purge system and a method of diagnosing a purge pump of an active dual purge system using an on-board diagnosis (OBD) according to one form of the present disclosure will be described with reference to the accompanying drawings.

FIG. 1 is an exemplary diagram illustrating an active dual purge system according to one exemplary form of the present disclosure. As shown in FIG. 1, the active dual purge system includes: an intake pipe 100 for connecting an air cleaner A to a surge tank S, a compressor 200 installed in the intake pipe 100 and configured to compress air, a canister 300 for collecting an evaporation gas evaporated from a fuel tank T, a purge line 400 extending from the canister 300 to a front end of the compressor 200 installed in the intake pipe 100, a branch line 500 extending between the purge line 400 and a rear end of a throttle valve body B provided in the intake pipe 100, a purge pump 600 installed in the purge line 400 to be located between the canister 300 and a branch position of the branch line 500, a purge valve 700 installed in the purge line 400 to be located between the branch position of the branch line 500 and the intake pipe 100, a vent line 1500 extending from the canister 300 toward the atmosphere, and a vent valve 1600 installed in the vent line 1500 and configured to control an opening degree of the vent line 1500.

In one form, the active dual purge system further includes a first valve 800 installed in the purge line 400 to be located between the branch position of the branch line 500 and the purge valve 700, a second valve 900 installed in the branch line 500 to be located between the branch position of the branch line 500 and the throttle valve body B, a first sensor 1100 installed in the purge line 400 to be located between the first valve 800 and the purge valve 700, a second sensor 1000 installed in the purge line 400 to be located between the canister 300 and the purge pump 600, a third sensor 1200 installed in the branch line 500 to be located between the second valve 900 and the throttle valve body B, a differential pressure generating valve 1300 provided in intake pipe 100 to be located between the air cleaner A and a connection point of the purge line 400 and the intake pipe 100, and a control unit 1400 for controlling the differential pressure generating valve 1300, the purge valve 700, the first valve 800, the second valve 900 and the purge pump 600. Here, the control unit or controller may be embodied in a hardware manner (e.g., a processor), a software manner, or combination of the hardware and the software manner (i.e., a series of commands), which process at least one function or operation described in the present disclosure.

In order to adjust an amount of an evaporation gas introduced into the front end of the compressor 200 and an amount of an evaporation gas introduced into the rear end of the throttle valve body B, the control unit 1400 performs duty control on an amount of opening degree of the differential pressure generating valve 1300, an amount of opening degree of the purge valve 700, an amount of opening degree of the first valve 800, and an amount of opening degree of the second valve 900 and controls revolutions per minute (RPM) of the purge pump 600.

The control unit 1400 receives signals from the first sensor 1100, the second sensor 1000, the third sensor 1200, a fuel injection module, a cooling water temperature measurement sensor, and a lambda sensor installed in an exhaust pipe and derives the amounts of opening degree of the differential pressure generating valve 1300, the purge valve 700, the first valve 800, and the second valve 900 and derives the RPM of the of the purge pump 600 by substituting the received signals into a graph, an equation, or a map.

In addition, the control unit 1400 performs one or more tests on the purge pump 600, the purge valve 700, and the vent valve 1600 which are in different operating states, thereby diagnosing whether the purge line 400, the branch line 500, and the vent line 1500 are abnormal using an OBD.

In addition, when the purge line 400, the branch line 500, and vent line 1500 are diagnosed as being abnormal, the control unit 1400 notifies a driver of failure occurrence, a failure content, and an estimated position of the failure occurrence through a warning device (not shown) and stores a failure occurrence history in an internal storage device.

Meanwhile, as a load of an engine becomes larger, a corrected mass flow rate due to an operation of the compressor 200 is high. When the evaporation gas is processed in a situation in which the corrected mass flow rate is high, the purge pump 600 operates such that, in a state in which the second valve 900 is closed, an evaporation gas (fuel vapor) is compressed between the purge pump 600 and the purge valve 700.

The fuel tank T is configured to store fuel, and, as the fuel is vaporized, the evaporation gas is generated in the fuel tank T.

The canister 300 collects the evaporation gas generated in the fuel tank T by, for example, activated carbon.

In some forms of the present disclosure, the first sensor 1100 and the second sensor 1000 are pressure sensors capable of measuring an inlet pressure and an outlet pressure of the purge pump 600. Meanwhile, the second sensor 1000 may be configured as a temperature sensor integrated-type pressure sensor in which a pressure sensor and a temperature sensor are integrally combined. Since a differential pressure condition of the purge pump 600 may be varied as a temperature of the evaporation gas is varied, the control unit 1400 adjusts duty control with respect to the purge pump 600 and the purge valve 700 according to the temperature of the evaporation gas measured from the second sensor 1000. In one form, the third sensor 1200 is a pressure sensor for measuring a pressure of a purge gas flowing to the throttle valve body B.

Figure 5:
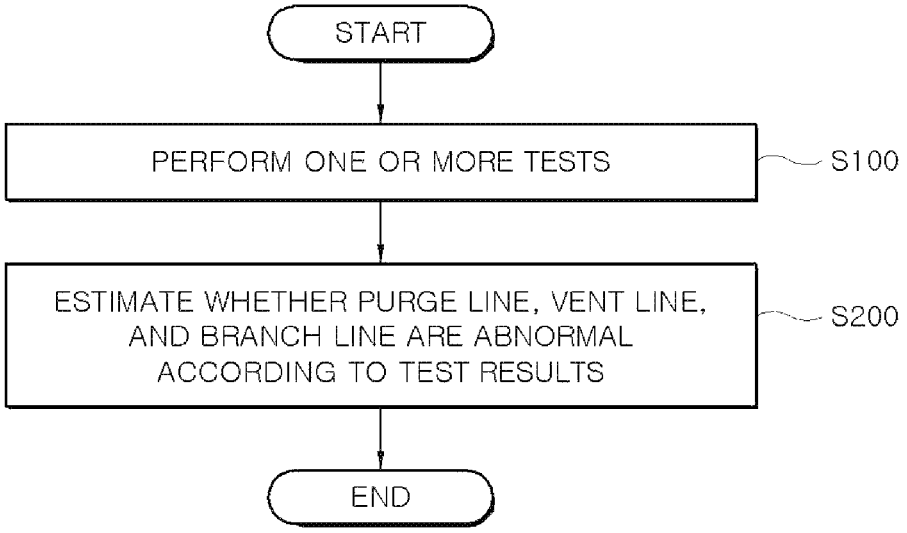
FIG. 5 is a flowchart illustrating a method of diagnosing an active dual purge system using on-board diagnosis (OBD) in one form of the present disclosure.

As shown in FIG. 5, the purge pump 600 is operated at an arbitrary RPM in the range of 0 RPM to 60000 RPM. An operating level of the purge pump 600 may be divided into four stages or twelve stages for each RPM. The purge pump 600 is operated with specific stages so that a compression speed and a compression rate of the evaporation gas between the purge pump 600 and the purge valve 700 may be adjusted.

The purge valve 700 may be opened or closed at a time when the RPM of the purge pump 600 is gradually adjusted, and the amount of opening degree of the purge valve 700 may be varied through the duty control. An amount of the evaporation gas introduced into the front end of the compressor 200 may be actively adjusted by controlling the compression rate of the evaporation gas which is present between the purge pump 600 and the purge valve 700 and an opening timing and an amount of opening degree of the purge valve 700.

In particular, on the basis of the signals generated from the first sensor 1100 and the second sensor 1000, it is possible to calculate a density of the compressed evaporation gas between the purge pump 600 and the purge valve 700, and it is possible to infer the amount of the evaporation gas introduced into the front end of the compressor 200 and, eventually, an amount of the evaporation gas introduced into a combustion chamber from the calculated density. Thus, it is possible to calculate an appropriate amount of fuel to be supplied to the combustion chamber at a time when the signals are generated in the first sensor 1100 and the second sensor 1000, and eventually, an amount of oxygen contained in the exhaust gas discharged from the engine before and after an evaporation gas processing may be maintained in an appropriate state.

In addition, the amount of the evaporation gas introduced into the front end of the compressor 200 may be actively adjusted according to a margin ratio of backflow in the compressor 200. That is, when the amount of the evaporation gas introduced into the front end of the compressor 200 is appropriately adjusted according to a compression ratio of the compressor 200, a corrected mass flow rate may be induced to not pass over a surge line, and eventually, discharge of the evaporation gas to the atmosphere due to a backflow of intake air and contamination of the air cleaner A are prevented.

Meanwhile, as a load of the engine becomes smaller, the corrected mass flow rate due to the compressor 200 is low. In this case, air in the atmosphere may be inhaled due to a pumping pressure generated in the engine. In this case, the first valve 800 is completely blocked and then the second valve 900 is opened to allow the evaporation gas to be induced into only the rear end of the throttle valve body B through the branch line 500. In addition, the amount of the evaporation gas introduced into the rear end of the throttle valve body B may be actively adjusted by adjusting the amount of opening degree of the second valve 900 and controlling the RPM of the purge pump 600.

Meanwhile, the second valve 900 may be completely blocked and then the amounts of opening degree of the purge valve 700, the first valve 800, and the differential pressure generating valve 1300 may be appropriately adjusted to induce the evaporation gas to be introduced into only the front end of the compressor 200. Even in this case, the amount of the evaporation gas introduced into the front end of the compressor 200 may be actively adjusted by adjusting the amounts of opening degree of the purge valve 700, the first valve 800, and the differential pressure generating valve 1300 and controlling the RPM of the purge pump 600.

Alternatively, the amounts of opening degree of the purge valve 700, the first valve 800, the second valve 900, and the differential pressure generating valve 1300 may be appropriately adjusted to induce the evaporation gas to be introduced into the front end of the compressor 200 and the rear end of the throttle valve body B. Even in this case, an amount of the evaporation gas introduced into the front end of the compressor 200 and the rear end of the throttle valve body B may be adjusted by adjusting the amounts of opening degree of the purge valve 700, the first valve 800, the second valve 900, and the differential pressure generating valve 1300 and controlling the RPM of the purge pump 600.

Figure 2:
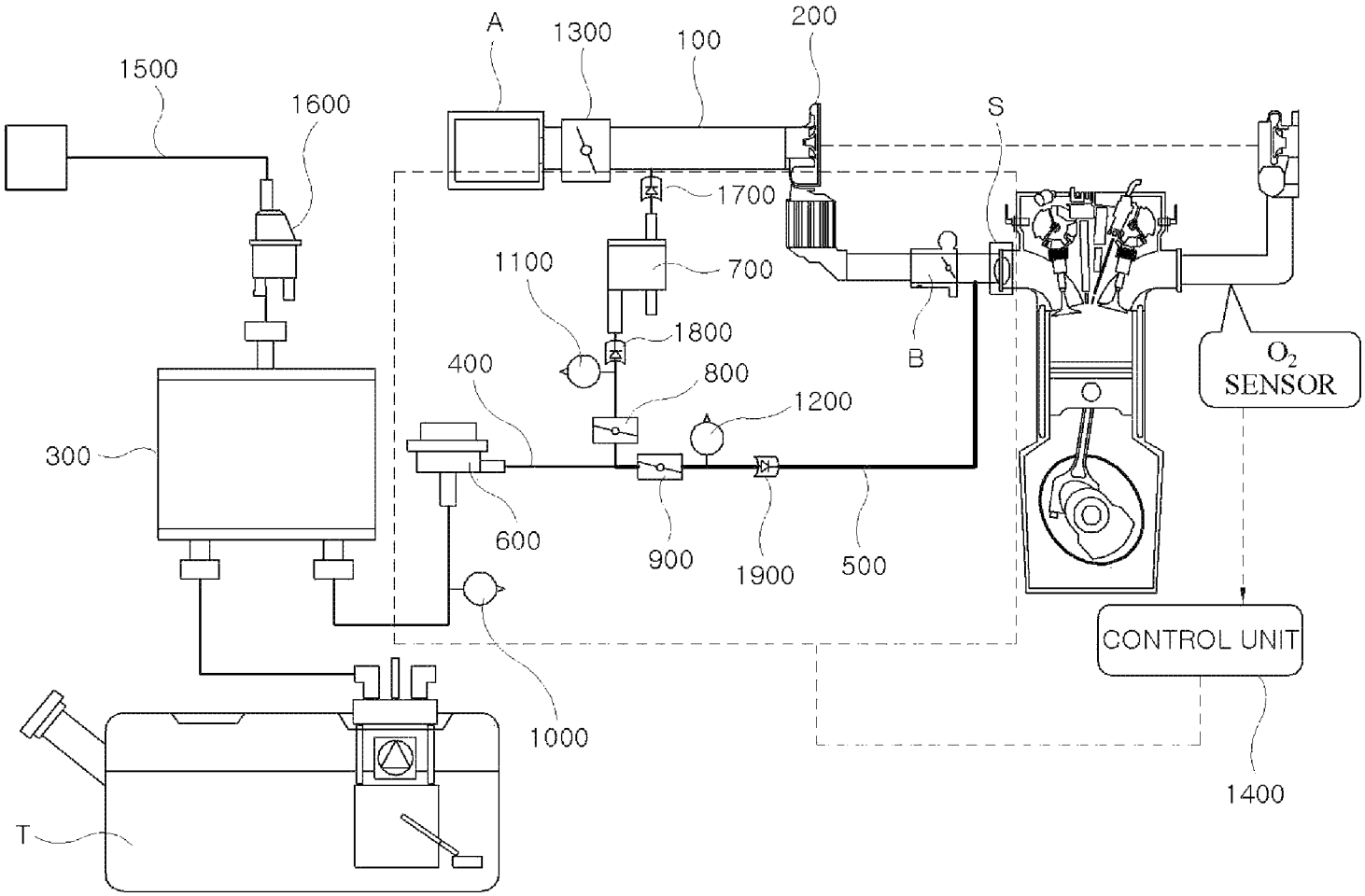
FIG. 2 is an exemplary diagram illustrating an active dual purge system in another exemplary form of the present disclosure.

FIG. 2 is an exemplary diagram illustrating an active dual purge system according to another exemplary form of the present disclosure. The exemplary form shown in FIG. 2 is the same as the form shown in FIG. 1, excluding that a first check valve 1700 provided in the purge line 400 between the purge valve 700 and the intake pipe 100, a second check valve 1800 provided in the purge line 400 between the first valve 800 and the purge valve 700, and a third check valve 1900 provided in the branch line 500 between the second valve 900 and the throttle valve body B are further included. Therefore, descriptions overlapping the form shown in FIG. 1 will be omitted herein.

In the active dual purge system according to another form shown in FIG. 2, the first check valve 1700 is provided in the purge line 400 between the purge valve 700 and the intake pipe 100 to direct a purge gas to flow only in one direction toward the intake pipe 100 so that it is possible to prevent air flowing in the intake pipe 100 from flowing back to the purge valve 700.

In addition, the second check valve 1800 is provided in the purge line 400 between the first valve 800 and the purge valve 700 to direct the purge gas to flow only in one direction toward the purge valve 700 so that it is possible to prevent air from flowing back from the purge valve 700 to the first valve 800.

Further, the third check valve 1900 is provided in the branch line 500 between the second valve 900 and the throttle valve body B to direct the purge gas to flow only in one direction toward the throttle valve body B so that it is possible to prevent the air flowing in an intake system from flowing back to the second valve 900.

Meanwhile, when the first check valve 1700 is connected to the compressor 200 on the intake pipe 100 using a hose or the like, a failure, including that clogging occurs in the hose or the hose is pulled out, may occur. In this case, determination whether the failure occurs may not be easy.

Figure 3A:
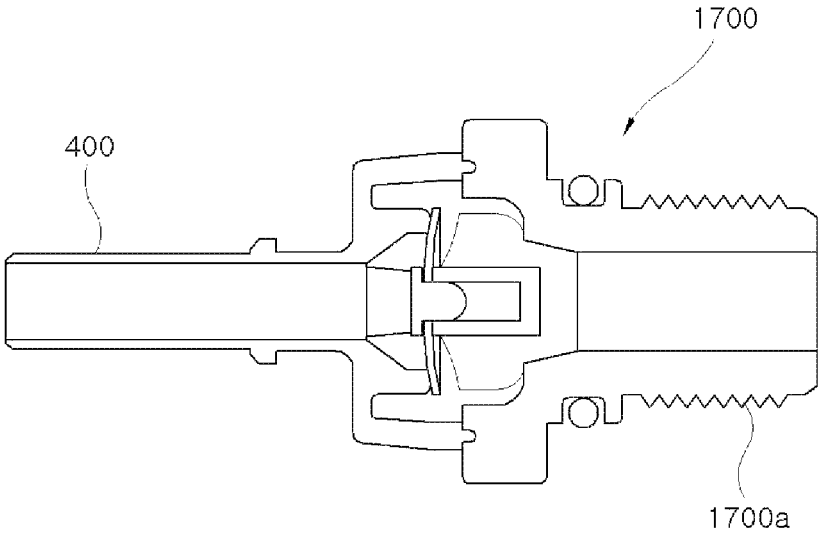
FIG. 3A is a cross-sectional view illustrating a check valve of the active dual purge system shown in FIG. 2.
Figure 3B:
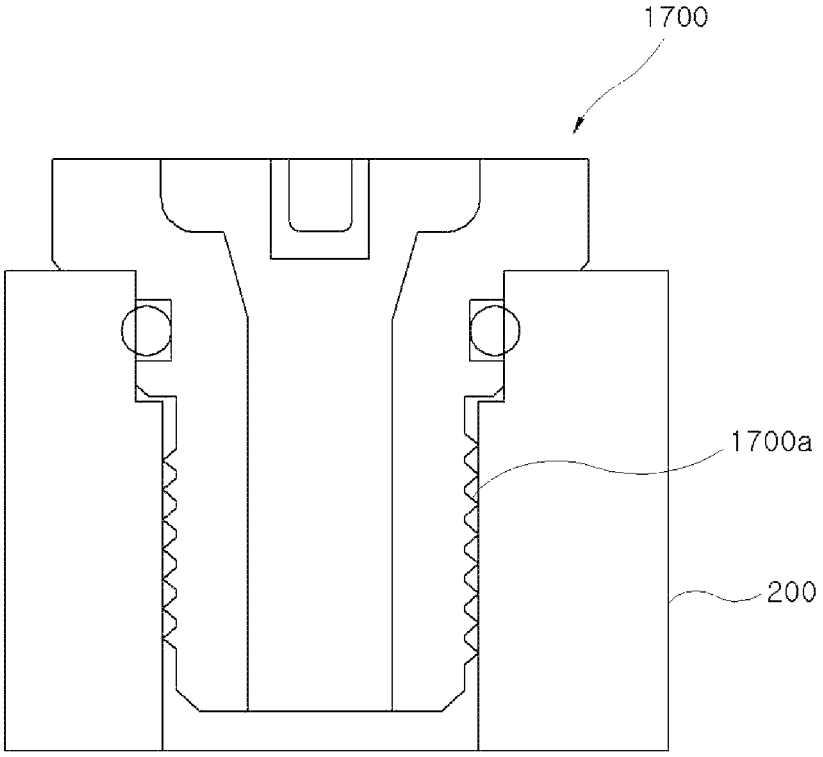
FIG. 3B is a cross-sectional view illustrating a coupling structure of the check valve and a compressor which are shown in FIG. 3A.

Thus, as shown in FIGS. 3A and 3B, according to an exemplary form of the present disclosure, the first check valve 1700 is directly engaged with (permanently fixed to) the compressor 200, and thus the first check valve 1700 and the compressor 200 are integrated so that a hose between the first check valve 1700 and the compressor 200 is omitted.

In the form shown in FIG. 3A, the first check valve 1700 is configured such that one end thereof is connected to the branch line 500 extending from the first valve 800 and the other end thereof is connected to the compressor 200, and a thread portion 1700*a* is provided on an outer circumference of the other end of the first check valve 1700 connected to the compressor 200. Thus, as shown in FIG. 3B, the thread portion 1700*a* provided on the outer circumference of the other end of the first check valve 1700 is screw-coupled to a screw hole provided in a housing of the compressor 200 so that the first check valve 1700 is directly connected to the compressor 200 and is integrated with the compressor 200.

However, the form of the present disclosure is not limited to the direct engagement part illustrated in FIGS. 3A and 3B as long as the first check valve 1700 is a part which is directly engaged with the compressor 200 and is integrated with the compressor 200. For example, instead of the screw coupling method illustrated in FIGS. 3A and 3B, it is also possible to bond and integrate the other end of the first check valve 1700 with the housing of the compressor 200 using an adhesive or the like.

Figure 4:
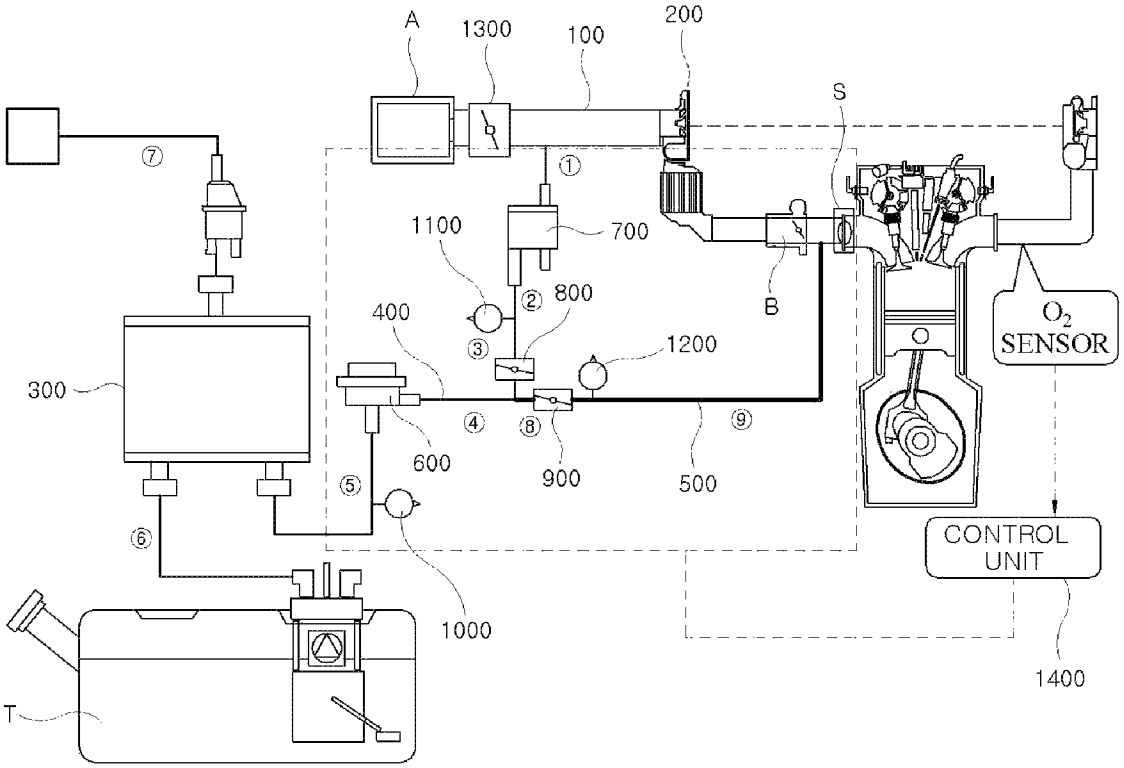
FIG. 4 is a diagram for describing a type of test according to each purge passage of the active dual purge system shown in FIG. 1.

Whether the active dual purge system according to one form of the present disclosure, which is configured as described above, fails is diagnosed using OBD according to the flowchart of FIG. 5. FIG. 4 is a diagram for describing a type of test according to each purge passage of the active dual purge system shown in FIG. 1, and FIG. 5 is a flowchart illustrating a method of diagnosing an active dual purge system using OBD according to one form of the present disclosure. Hereinafter, a method of diagnosing an active dual purge system using OBD according to one exemplary form of the present disclosure will be described in detail with reference to FIGS. 4 and 5.

As shown in FIG. 5, the method of diagnosing an active dual purge system using OBD according to one form of the present disclosure includes performing one or more tests (S100), and estimating clogging or disconnection due to pulling out of the hose with respect to the purge line 400, the vent line 1500, and the branch line 500 and estimating failures of the purge pump 600, the purge valve 700, and the check valves 1700, 1800, and 1900 on the basis of the test results (S200).

In some forms of the present disclosure, the tests include Test A (or "first test") for diagnosing a failure of the purge valve 700, Test B (or "second test") for diagnosing an internal pressure range of the purge line 400, Test C (or "third test") for diagnosing a leakage of the purge line 400, Test D (or "fourth test") for diagnosing whether the purge line 400 is vacuumed, and Test E (or "fifth test") for diagnosing a load of the canister 300.

Test A is performed in a state in which the purge pump 600 is not operated, the amount of opening degree of the purge valve 700 is 50%, and the vent valve 1600 is opened. Test B is performed in a state in which the purge pump 600 is operated, the amount of opening degree of the purge valve 700 is 100%, and the vent valve 1600 is opened. Test C is performed in a state in which the purge pump 600 is not operated, the amount of opening degree of the purge valve 700 is 0%, and the vent valve 1600 is closed. Test D is performed in a state in which the purge pump 600 is operated, the amount of opening degree of the purge valve 700 is 100%, and the vent valve 1600 is closed. Test E is performed in a state in which the purge pump 600 is not operated, the amount of opening degree of the purge valve 700 is 100%, and the vent valve 1600 is opened.

When Tests A to E are performed, the pass or fail of each of Tests A to E is determined on the basis of magnitudes of the signals generated in the first sensor 1100 and the second sensor 1000 and the RPM of the purge pump 600. When Tests A to E are performed, an appropriate range of the magnitudes of the signals generated in the first sensor 1100 and the second sensor 1000 and an appropriate range of the RPM of the purge pump 600 are determined through an experiment performed in advance. During the performing of Tests A to E, when the RPM and the magnitudes of the signals fall within a predetermined appropriate range with respect to a section which is a target of determination whether a failure occurs, Tests A to E are determined to pass, whereas, when the RPM and the magnitudes of the signals do not fall within the predetermined appropriate range, Tests A to E are determined to fail.

The purge line 400 includes a first section ① between the purge valve 700 and the intake pipe 100, a second section ② between the purge valve 700 and the first sensor 1100, a third section ③ between the first sensor 1100 and the first valve 800, a fourth section ④ between the purge pump 600 and the branch position, and a sixth section ⑥ connecting the fuel tank T to the canister 300. The vent line 1500 includes a seventh section ⑦ extending from the canister 300 to the atmosphere via the vent valve 1600 and includes the fuel tank T and the canister 300. The branch line 500 includes an eighth section ⑧ between the branch position and the second valve 900 and a ninth section ⑨ between the second valve 900 and the throttle valve body B.

Here, in the first section ①, when either Test A or Test E fails, it is estimated that disconnection or a pulling out of the hose occurs, and, when Test A, Test B, and Test E fail, it is estimated that the hose is clogged. In the fourth section ④, when Test A, Test B, Test C, Test D, and Test E fail, it is estimated that the disconnection or the pulling out of the hose occurs, and, when Test A, Test B, Test D, and Test E fail, it is estimated that the hose is clogged. In the fifth section ⑤, when Test C and Test D fail, it is estimated that the disconnection or the pulling out of the hose occurs, and, when Test D fails, it is estimated that the hose is clogged. In the sixth section ⑥, when Test C, Test B, Test D, and Test E fail, it is estimated that the disconnection or the pulling out of the hose occurs, and, when Test D and Test E fail, it is estimated that the hose is clogged. In addition, in the seventh section ⑦, when Test D fails, it is estimated that the hose is clogged.

Further, a failure of the purge valve 700 is estimated on the basis of the results of Test A, Test C, and Test E, and a failure of the purge pump 600 is estimated on the basis of the results of Test B and Test D.

In another form, as described in FIG. 2 the first check valve 1700 is provided between the purge valve 700 and the intake pipe 100 in the purge line 400, the second check valve 1800 is provided between the first valve 800 and the purge valve 700 in the purge line 400, and the third check valve 1900 is provided between the second valve 900 and the throttle valve body B in the branch line 500.

In one form, a Test F (or "sixth test") is performed to determine whether the first to third check valves 1700, 1800, and 1900 installed in the purge line 400 and the branch line 500 are abnormal. In this case, the Test F is performed in a state in which the purge pump 600 is not operated, the amount of opening degree of the purge valve 700 is 50%, and the vent valve 1600 is opened.

In addition, in the second section ② according to the form of FIG. 4, when any one among Test A, Test B, Test C, Test D, Test E, and Test F fails, it is estimated that the disconnection or the pulling out of the hose occurs, and, when Test A, Test B, and Test E fail, it is estimated that the hose is clogged. In the third section ③, when any one among Test A, Test B, Test C, Test D, Test E, and Test F fails, it is estimated that the disconnection or the pulling out of the hose occurs, and, when Test A, Test B, Test E, and Test F fail, it is estimated that the hose is clogged. In the eighth section ⑧, when any one among Test A, Test B, Test C, Test D, Test E, and Test F fails, it is estimated that the disconnection or the pulling out of the hose occurs, and, when Test A, Test B, Test E, and Test F fail, it is estimated that the hose is clogged. In the ninth section ⑨, when any one among Test A, Test B, Test C, Test D, Test E, and Test F fails, it is estimated that the disconnection or the pulling out of the hose occurs, and, when Test A, Test B, and Test E fail, it is estimated that the hose is clogged.

In addition, in Test F, when whether each of the first to third check valves 1700, 1800, and 1900 is abnormal is checked, Test F is performed in a state in which only a check valve which is a target of diagnosis is opened and the remaining check valves are closed so that it is determined whether the target check valve is abnormal according to whether a flow rate of the purge gas in a section in which the target check valve is installed satisfies a predetermined condition.

In addition, when the purge line 400, the branch line 500, and vent line 1500 are diagnosed as being abnormal, and when it is determined that a failure occur in the purge pump 600, the purge valve 700, or the check valves 1700, 1800, or 1900, the control unit 1400 notifies a driver of failure occurrence, a failure content, and an estimated position of the failure occurrence through a warning device (not shown) and stores a failure occurrence history in an internal storage device.

In accordance with the method of diagnosing a failure of an active dual purge system according to one form of the present disclosure, which is configured as described above, Test A to Test F are performed, it is possible to estimate a state of each section between the purge line 400, the branch line 500, and the vent line 1500 and determine the failure of the purge pump 600, the purge valve 700, or the check valves 1700, 1800, or 1900.

In addition, when the failure is diagnosed as occurring, the control unit 1400 displays failure occurrence and a position and a content of the failure occurrence as a warning message through an instrument panel installed in a driver seat of the vehicle or a separate monitor installed in a dashboard so that the driver is directed to recognize the failure occurrence and a failure content. Thus, it is possible to reduce a maintenance cost of the vehicle by guiding the drive to check and replace only a part in which a failure occurs.

In addition, since the evaporation gas is compressed due to the operation of the purge pump 600, even when the internal pressure of the intake pipe 100 is greater than or equal to an atmospheric pressure, the evaporation gas may be supplied to the intake pipe 100.

In accordance with an active dual purge system according to one form of the present disclosure, which is configured as described above, a flow rate of an evaporation gas introduced into a front end of a compressor can be actively controlled, and a flow rate of the evaporation gas introduced into a rear end of a throttle valve body can also be actively controlled by adjusting amounts of opening degree of a purge valve, a first valve, a second valve, and a differential pressure generating valve and adjusting RPM of a purge pump.

In particular, when a backflow of intake air occurs due to a compressor according to an environment in which a vehicle is driving, and a corrected mass flow rate generated in a compressor, an amount of the evaporation gas can be actively reduced so that it is possible to prevent the evaporation gas from flowing back with the intake air, contaminating an air cleaner, or being discharged into the atmosphere.

In addition, in accordance with the active dual purge system according to one form of the present disclosure, a check valve installed in a purge line branching off to an intake pipe is integrated with the compressor so that it is possible to prevent a hose from being pulled out or leaking between the check valve and the intake pipe.

In addition, in accordance with a method of diagnosing an active dual purge system using on-board diagnosis (OBD) according to one form of the present disclosure, a leak of a purge passage and clogging of the hose, which may occur in the active dual purge system, are accurately diagnosed so that a driver can be warned of the leak and the clogging to estimate whether a failure occurs and a position of the failure. Therefore, when the failure occurs, it is possible to reduce a time and costs in conjunction with repair.

In addition, in accordance with the above-described the present disclosure, when the leak of the purge passage or clogging of the hose occurs in the active dual purge system, a purge operation can be interrupted to prevent an evaporation gas of fuel from being discharged to the atmosphere.

While the present disclosure has been described with respect to the specific forms, it will be apparent to those skilled in the art that various changes and modifications may be made without departing from the spirit and scope of the present disclosure as defined in the following claims. Accordingly, it should be noted that such alternations or modifications fall within the present disclosure.

What is claimed is:

1. An active dual purge system, comprising:

an intake pipe;

a compressor installed in the intake pipe and configured to compress air;

a canister configured to collect an evaporation gas evaporated in a fuel tank;

a purge line extending from the canister to a front end of the compressor in the intake pipe;

a branch line branching off from the purge line and extending to a rear end of a throttle valve body provided in the intake pipe;

a purge pump installed in the purge line and located between the canister and a branch position of the branch line;

a purge valve installed in the purge line and located between the branch position of the branch line and the intake pipe;

a vent valve installed in a vent line extending from the canister;

a first sensor installed in the purge line and located between the purge pump and the purge valve;

a second sensor installed in the purge line and located between the canister and the purge pump; and a control unit configured to:

perform different tests on the purge pump, the purge valve and the vent valve, which are in different operating states, and diagnose whether at least one of the purge line, the branch line, or the vent line is abnormal using on-board diagnosis (OBD).

2. The active dual purge system of claim 1, further comprising:

a first valve installed in the purge line and located between the branch position of the branch line and the purge valve;

a second valve installed in the branch line and located between the branch position of the branch line and the throttle valve body; and a third sensor installed in the branch line to be located between the second valve and the throttle valve body, wherein the first sensor is located between the first valve and the purge valve.

3. The active dual purge system of claim 2, further comprising:

a differential pressure generating valve provided in the intake pipe and located between a connection point of the purge line and the intake pipe and an air cleaner provided in the intake pipe, wherein the control unit is configured to control the differential pressure generating valve, the purge valve, the first valve, the second valve, and the purge pump.

4. The active dual purge system of claim 3, further comprising:

a first check valve installed in the purge line and located between the purge valve and the intake pipe;

a second check valve installed in the purge line and located between the first valve and the purge valve; and a third check valve installed in the branch line and located between the second valve and the throttle valve body.

5. The active dual purge system of claim 4, wherein the first check valve is directly engaged with the compressor and is integrated therewith.

6. The active dual purge system of claim 5, wherein an outer circumference of an end portion of a discharge side of the first check valve is screw-coupled to the compressor and directly engaged with the compressor.

7. The active dual purge system of claim 5, wherein an outer circumference of an end portion of a discharge side of the first check valve is bonded to the compressor by an adhesive and directly engaged with the compressor.

8. A method of diagnosing an active dual purge system using on-board diagnosis (OBD), where the active dual purge system includes an intake pipe, a compressor installed in the intake pipe and configured to compress air, a canister configured to collect an evaporation gas evaporated in a fuel tank, a purge line extending from the canister to a front end of the compressor in the intake pipe, a branch line branching off from the purge line and extending to a rear end of a throttle valve body provided in the intake pipe, a purge pump installed in the purge line to be located between the canister and a branch position of the branch line, a purge valve installed in the purge line to be located between the branch position of the branch line and the intake pipe, a vent valve installed in a vent line extending from the canister, a first sensor installed in the purge line to be located between the purge pump and the purge valve, and a second sensor installed in the purge line to be located between the canister and the purge pump, the method comprising:

performing, by a control unit, at least one test on the purge pump, the purge valve, and the vent valve, which are in different operating states; and diagnosing, by the control unit, whether at least one of the purge line, the branch line, or the vent line are abnormal using the OBD.

9. The method of claim 8, wherein the at least one test include at least one of a first test for diagnosing a failure of the purge valve, a second test for diagnosing an internal pressure range of the purge line, a third test for diagnosing a leakage of the purge line, a fourth test for diagnosing whether the purge line is vacuumed, or a fifth test for diagnosing a load of the canister.

10. The method of claim 9, wherein:

the first test is performed in a state in which the purge pump is not operated, an opening degree of the purge valve is 50%, and the vent valve is opened;

the second test is performed in a state in which the purge pump is operated, the opening degree of the purge valve is 100%, and the vent valve is opened;

the third test is performed in a state in which the purge pump is not operated, the opening degree of the purge valve is 0%, and the vent valve is closed;

the fourth test is performed in a state in which the purge pump is operated, the opening degree of the purge valve is 100%, and the vent valve is closed; and the fifth test is performed in a state in which the purge pump is not operated, the opening degree of the purge valve is 100%, and the vent valve is opened.

11. The method of claim 9, wherein the at least one test further includes a sixth test for diagnosing whether at least one check valve is abnormal, where the at least one check valve includes: a first check valve installed in the purge line and located between the purge valve and the intake pipe; a second check valve installed in the purge line and located between the first check valve and the purge valve; and a third check valve installed in the branch line and located between the second check valve and the throttle valve body, and wherein the sixth test is performed in a state in which the purge pump is not operated, an opening degree of the purge valve is 50%, and the vent valve is opened.

12. The method of claim 8, wherein, in performing the at least one test, determining whether a magnitude of a signal generated by the first sensor, a magnitude of a signal generated by the second sensor, and revolutions per minute (RPM) of the purge pump are within a predetermined appropriate range, and diagnosing whether at least one of the purge line, the branch line, or the vent line is abnormal using the OBD and a result of the determination.

13. The method of claim 9, wherein, in a first section between the purge valve and the intake pipe in the purge line, when either the first test or the fifth test fails, it is estimated that a leak or a pulling out of a hose constituting the purge line occurs, and when at least one test among the first test, the second test, and the fifth test fails, it is estimated that clogging of the hose constituting the purge line occurs.

14. The method of claim 9, wherein, in a fourth section between the purge pump and the branch position in the purge line, when at least one test among the first test, the second test, the third test, the fourth test, and the fifth test fails, it is estimated that a leak or a pulling out of a hose constituting the purge line occurs, and when at least one test among the first test, the second test and the fourth test fails, it is estimated that clogging of the hose constituting the purge line occurs.

15. The method of claim 9, wherein, in a fifth section between the purge pump and the canister in the purge line, when either the third test or the fourth test fails, it is estimated that a leak or a pulling out of a hose constituting the purge line occurs, and when the fourth test fails, it is estimated that clogging of the hose constituting the purge line occurs.

16. The method of claim 9, wherein, in a sixth section between the canister and the fuel tank in the purge line, when at least one test among the second test, the third test, the fourth test and the fifth test fails, it is estimated that a leak or a pulling out of a hose constituting the purge line occurs, and when either the fourth test or the fifth test fails, it is estimated that clogging of the hose constituting the purge line occurs.

17. The method of claim 9, wherein, in a seventh section which is the vent line, when the fourth test fails, it is estimated that clogging of a hose constituting the vent line occurs.

18. The method of claim 11, wherein, in a second section between the purge valve and the first sensor in the purge line, when at least one test among the first test, the second test, the third test, the fourth test, the fifth test, and the sixth test fails, it is estimated that a leak or a pulling out of a hose constituting the purge line occurs, and when at least on test among the first test, the second test and the fifth test fails, it is estimated that clogging of the hose constituting the purge line occurs.

19. The method of claim 11, wherein, in a third section between the first sensor and the first check valve in the purge line, when at least one test among the first test, the second test, the third test, the fourth test, the fifth test and the sixth test fails, it is estimated that a leak or a pulling out of a hose constituting the purge line occurs, and when at least one test among the first test, the second test, the fifth test, and the sixth test fails, it is estimated that clogging of the hose constituting the purge line occurs.

20. The method of claim 11, wherein, in an eighth section between the branch position and the second sensor in the branch line, when at least one test among the first test, the second test, the third test, the fourth test, the fifth test, and the sixth test fails, it is estimated that a leak or a pulling out of a hose constituting the purge line occurs, and when at least one test among the first test, the second test, the fifth test, and the sixth test fails, it is estimated that clogging of the hose constituting the purge line occurs.

21. The method of claim 11, wherein, in a ninth section between the second sensor and the intake pipe in the purge line, when at least one test among the first test, the second test, the third test, the fourth test, the fifth test, and the sixth test fails, it is estimated that a leak or a pulling out of a hose constituting the purge line occurs, and when at least one test among the first test, the second test, and the fifth test fails, it is estimated that clogging of the hose constituting the purge line occurs.

* * * * *